United States Patent [19]

Flinn et al.

[11] 4,441,535

[45] Apr. 10, 1984

[54] MOBILE LOG SAWING AND SPLITTING MACHINE

[75] Inventors: John W. Flinn, Brampton; James D. Johnson; Ward L. Stiemert, both of Escanaba, all of Mich.

[73] Assignee: Gafner Machine, Inc., Escanaba, Mich.

[21] Appl. No.: 479,875

[22] Filed: Mar. 29, 1983

[51] Int. Cl.[3] ..... B27L 7/00

[52] U.S. Cl. ..... 144/3 K; 144/193 R; 83/159; 83/210; 83/282; 83/390

[58] Field of Search ..... 144/3 K, 193 R, 366; 83/208, 157, 158, 159, 160, 210, 282, 380, 388, 391, 390, 452

[56] References Cited

U.S. PATENT DOCUMENTS

| | | | |
|---|---|---|---|
| 1,441,996 | 1/1923 | Mukai | 144/3 K |
| 3,862,651 | 1/1975 | Helhhlnen | 144/3 K |
| 4,128,117 | 12/1978 | Terry | 144/3 K |
| 4,164,965 | 8/1979 | Bodart | 144/3 K |
| 4,294,295 | 10/1981 | Olin | 144/3 K |

FOREIGN PATENT DOCUMENTS

| | | | |
|---|---|---|---|
| 1028933 | 4/1978 | Canada | 144/3 K |
| 1923164 | 11/1970 | Fed. Rep. of Germany | 144/3 K |

*Primary Examiner*—W. D. Bray

*Attorney, Agent, or Firm*—Vernon J. Pillote

[57] ABSTRACT

A mobile log sawing and splitting machine including trailer frame having a vehicle engaging hitch at its forward end and ground engaging wheels at its rear end, with a saw mandrel mounted to extend crosswise of the beam adjacent its rear end and a log splitting mechanism mounted lengthwise of the beam for splitting cut-off sections of the logs. An internal combustion engine is mounted to enable quick disengagement of the engine from the drives for the log saw and log splitting mechanisms to facilitate starting and/or selectively disconnection of the drive to one or the other of the mechanisms. An upper saw guard is mounted for turning about the axis of the saw mandrel in response to movement of the log support mechanism during a cutting operation, and a lower stationary saw guard is arranged to receive the upper saw guard. The lengthwise extending trailer beam also functions as a hydraulic reservoir for the hydraulic power system.

12 Claims, 6 Drawing Figures

MOBILE LOG SAWING AND SPLITTING MACHINE

BACKGROUND OF THE INVENTION

The present invention pertains to a mobile machine for cutting logs into lengths and for splitting the cut lengths for use as firewood and the like. Prior art devices of this character are disclosed in U.S. Pat. Nos. 3,862,651; 4,128,117 and 4,164,965. In general, these prior machines include a log saw and a hydraulically operated log splitting mechanism mounted on a mobile frame with an internal combustion engine power source. The hydraulically operated log splitting mechanism in each of these patents is powered by a hydraulic pump driven from the internal combustion engine. In U.S. Pat. No. 4,128,117, the saw is driven through a belt drive from the internal combustion engine and in U.S. Pat. No. 4,164,965 the saw is driven by a hydraulic motor powered by the hydraulic pump driven from the internal combustion engine.

SUMMARY OF THE INVENTION

The present invention relates to a mobile combination log sawing and splitting machine having an internal combustion engine for driving the saw and the hydraulic pump for the hydraulically operated log splitting mechanism.

It is an object of this invention to provide a mobile combination log sawing and splitting machine of the type described having an improved mounting arrangement for the internal combustion engine and which enables selective engagement and disengagement of the internal combustion engine from the saw and from the pump for the hydraulically operated log splitting mechanism to facilitate starting of the engine, and to also facilitate connection and disconnection of the internal combustion engine from either the saw or the hydraulic pump so that the saw and log splitting can be operated either simultaneously or one at a time if desired.

Another object of this invention is to provide a mobile combination log saw and splitting mechanism of the type described having an improved arrangement for guarding the saw blade to protect the persons operating the cut-off saw as well as to protect the person operating the log splitting mechanism.

Yet another object of this invention is to provide a mobile combination log sawing and splitting machine of the type described in which the hydraulic reservoir for the hydraulically operated log splitting mechanism is provided in a longitudinally extending beam forming a central frame member for the mobile log sawing and splitting machine.

These, together with other objects, features and advantages of this invention will be more readily understood by reference to the following detailed description, when taken in connection with the accompanying drawings wherein.

Figure 1:
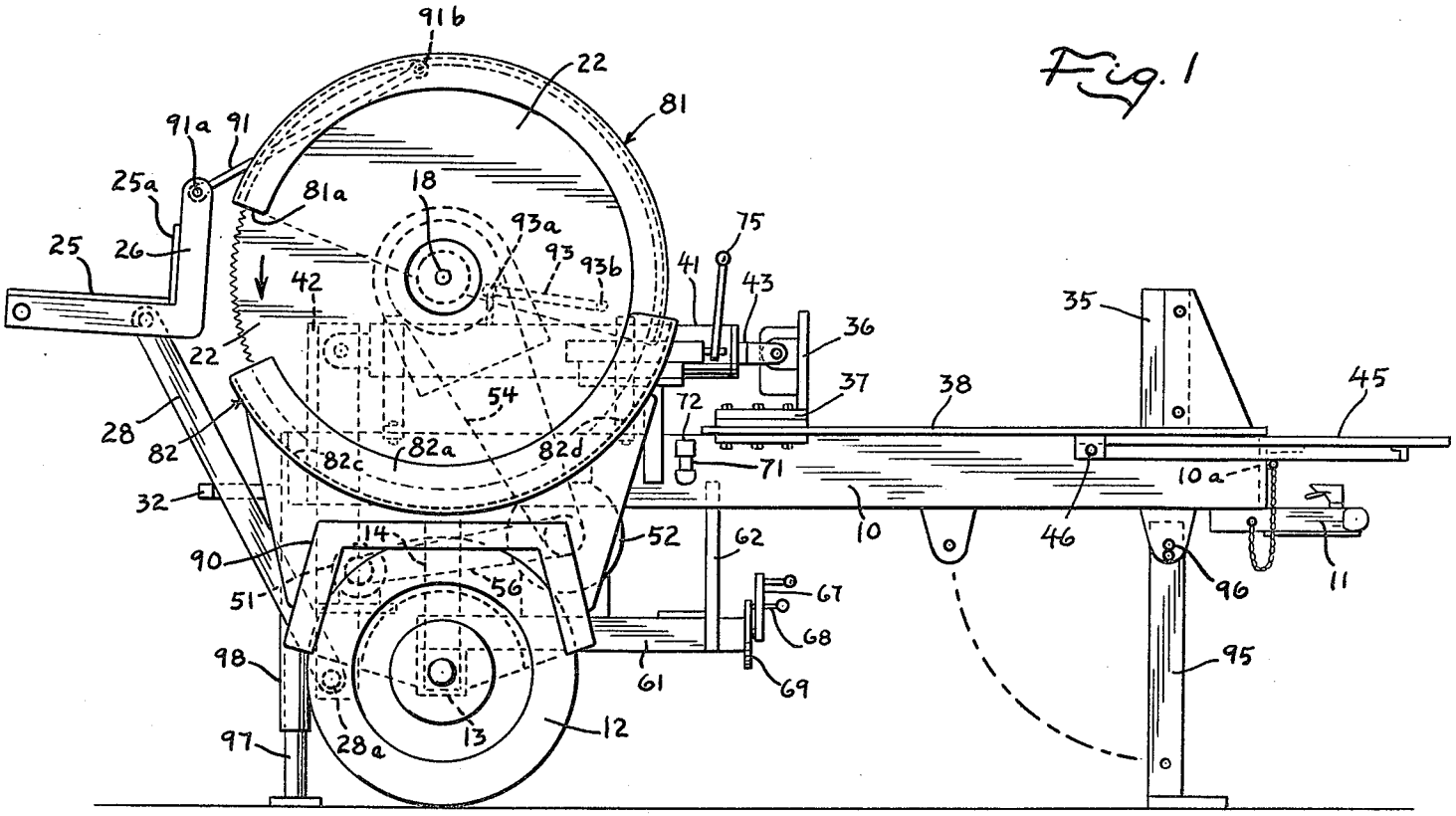
FIG. 1 is a side elevational view of one side of a log sawing and splitting machine.
Figure 2:
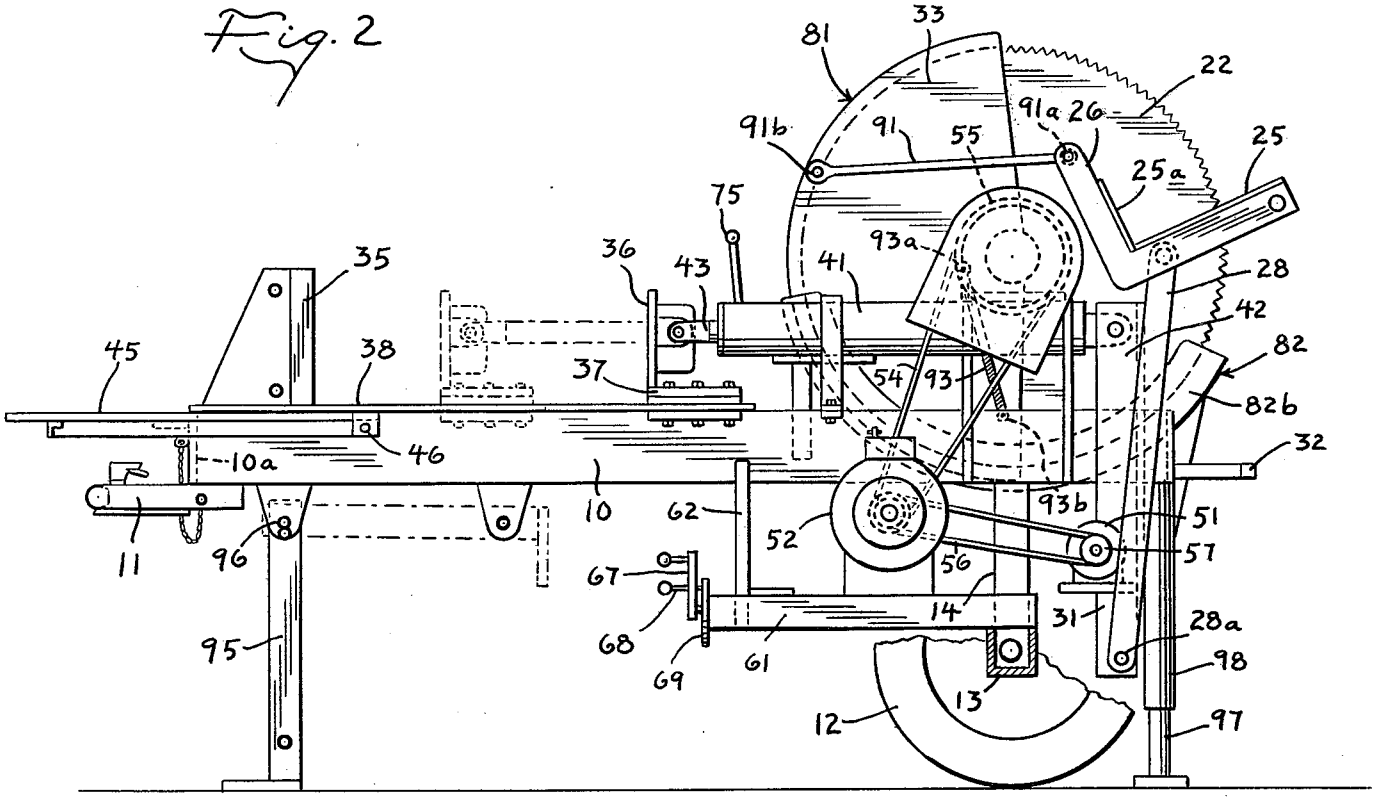
FIG. 2 is a side elevational view of the other side of the log saw and splitting machine.

The mobile log sawing and splitting machine includes a trailer frame having an elongated beam 10 with a vehicle engaging hitch 11 at its forward end and a pair of ground engaging wheels 12 mounted on a transverse axle 13 that is attached by an upright frame member 14 to the beam adjacent the rear end of the latter. A saw mandrel 18 is supported on journals 19 mounted on an upper frame structure 21, for rotation about an axis transverse to and spaced above the beam adjacent its rear end. The mandrel 18 extends to one side of the trailer and has a circular saw 22 detachably secured to the end at that side of the tractor. A horizontal log support 25 extends crosswise of the trailer frame at its rear end and is mounted for movement between a rear position adjacent the rear side of the saw blade as shown in FIG. 1, to a forward position adjacent the mandrel. The log support 25 has an upwardly extending wall **25*a* adjacent its forward end to laterally position the log, and the log support 25 and wall 25*a* are notched as indicated at 25*b* at a location to receive the saw blade when the log support is moved from its rear to its forward position. In the embodiment shown, the log support and wall 25*a* are formed from sheet stock to have a generally L-shaped cross-section and generally L-shaped reinforcing members 26 are secured as by welding at spaced locations along the log support. A tubular member 27 extends through openings in the upper ends of the L-shaped members 26 at a location above the rear wall 25*a* to provide a handle which can be grasped by the operator for moving the log support in a sawing operation. The log support is preferably supported for swinging movement between its rear and forward positions and, as shown, a pair of arms 28 are rigidly secured at their upper ends as by welding to selected ones of the L-shaped support members 26, and the arms 28 are swingably supported at their lower ends on a tubular support member 29 secured by a bracket 31 to the rear end of the beam for movement about a swing axis 28*a*. As best shown in FIGS. 1 and 2, the swing axis 28*a* for the log support is spaced below the beam at a location such that the arms 28 move from a rearwardly and upwardly inclined position when the log support is in its rear position as shown in FIG. 1 toward a generally upright position as the log support is moved to its forward position. The log support 25 is disposed in a generally horizontal plane when the log support is in its rear position and the log support 25 becomes inclined downwardly and forwardly as the support is moved toward its forward position as shown in FIG. 2. A stop bar 32 is secured to the rear end of the beam 10 and extends crosswise rearwardly of the arms 28 at a location to engage and stop the arms, when the log support is in its rear position shown in FIG. 1**.

Figures 5, 6:
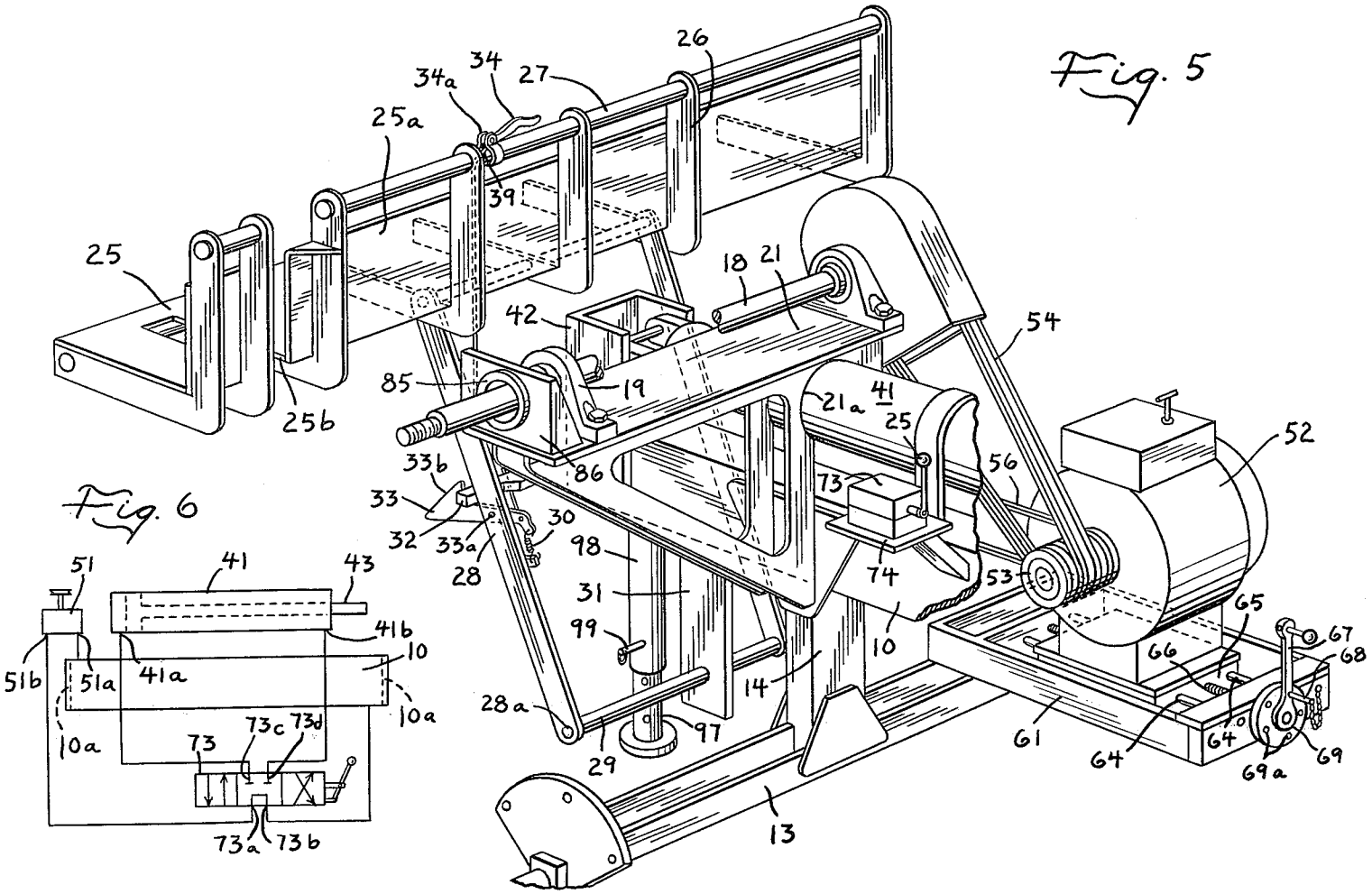
FIG. 5 is a fragmentary perspective view of a portion of the log sawing and splitting machine.

As shown in FIG. 5, a latch 33 is pivotally mounted by a bolt **33*a* on one of the arms 28 at a location to engage the stop bar to releasably latch the log support in a retracted position. The latch 33 is yieldably biased by a spring 30 to a latch position and has a cam nose 33*b* arranged to cam the latch over the stop bar when the log support is retracted. An operating lever 34 is pivotally mounted at 34*a* on the tubular member 27 and is connected through a bowden cable 39 to the latch. The lever 34 extends alongside the tubular member at a location spaced from the saw blade and such that it is operated to release the latch when one hand of the operator grasps the lever and the contiguous portion of the member 27** to push the log support forwardly in a sawing operation.

A log splitting wedge 35 is mounted on the upper side of the beam 10 adjacent its forward end. A log pusher 36 is secured to a carriage 37 that is slidably supported on a plate 38 on the upper side of the forward portion of the beam, for movement lengthwise of the beam toward and away from the log splitting wedge 35. A hydraulic ram is provided for extending and retracting the pusher 36 and includes a cylinder 41 anchored at its rear end by brackets 42 on the beam, and a piston rod 43 connected to the pusher 36. The ram cylinder 41 extends lengthwise along the top of the beam and below the mandrel 18, through openings 21*a* (FIG. 5) in the upper frame structure 21. A plate 45 is mounted on the forward end of the beam to extend along opposite sides of the log splitting wedge to provide a temporary support for the log sections. The plate 45 is advantageously swingably mounted at 46 at its rear end on the beam to enable swinging of the plate to a rearward storage position overlying the beam and away from the hitch 11.

Figure 3:
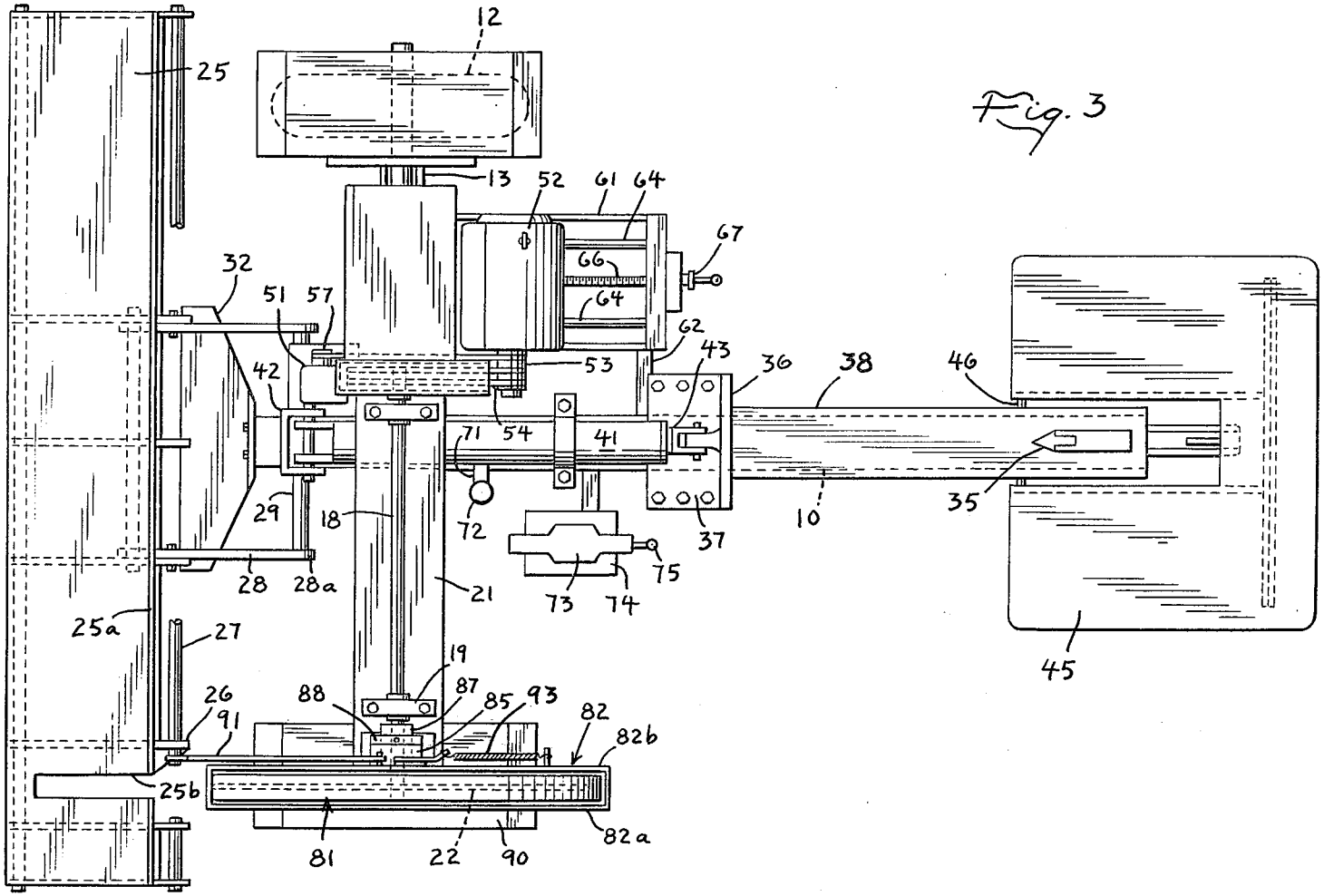
FIG. 3 is a top plan view of the log sawing and splitting machine.
Figure 4:
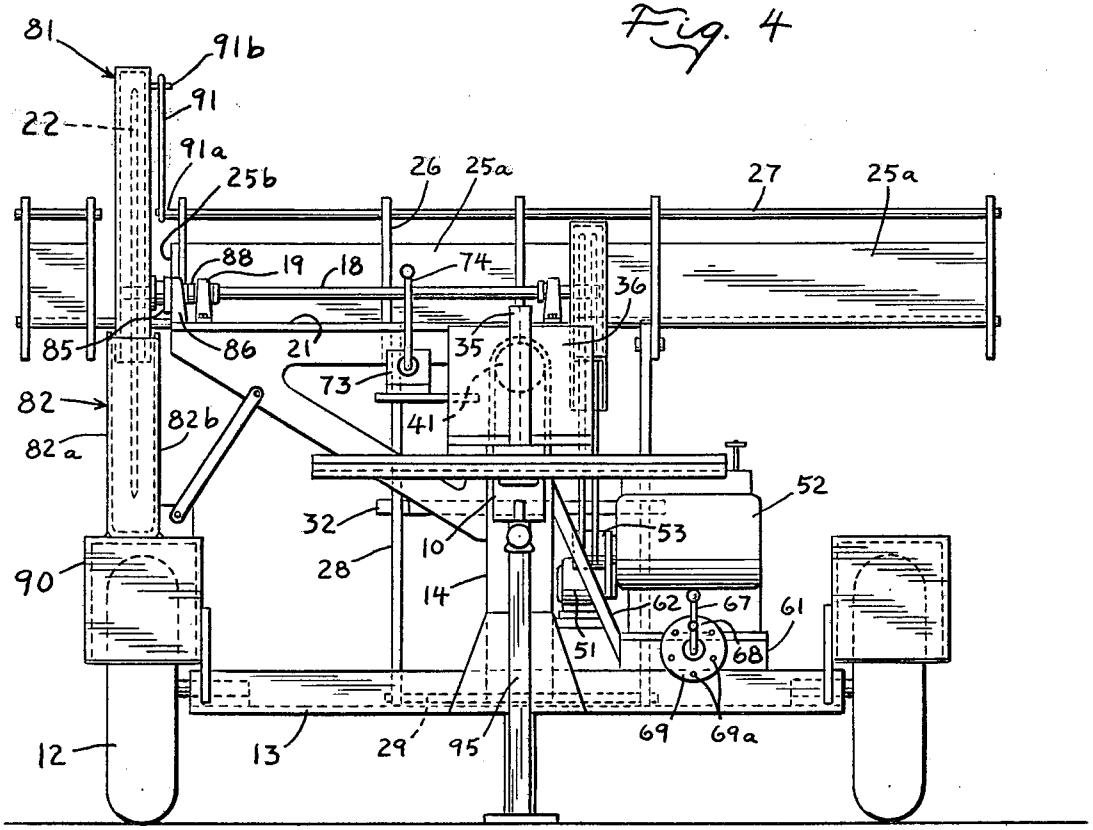
FIG. 4 is a front elevational view of the log sawing and splitting machine.

A hydraulic pump 51 is mounted on the trailer frame adjacent its rear end for supplying hydraulic fluid to the ram cylinder, and an internal combustion engine 52 is provided for driving the saw and the pump. As best shown in FIGS. 3 and 5, the internal combustion engine has a multiple groove pulley 53 on its output shaft and which pulley is connected through a belt drive including belts 54 and a pulley 55 on the mandrel to drive the saw, and which multiple groove pulley 53 is also connected through a belt drive including a belt 56 to a pulley 57 on the input shaft of the pump 51. The internal combustion engine is adjustably mounted on the trailer in a manner to enable tensioning and release of tension in the belt drives for both the saw and pump. The engine mount includes an engine support frame 61 secured at its rear end to the axle 13 and supported at its forward end by a bracket 62 on the beam at the side remote from the saw blade. The engine support frame includes a pair of guide rods 64 and an engine mounting pad 65 (FIG. 5) is slidably mounted on the rods 64 for sliding movement along an adjustment path having at least a substantial component that extends lengthwise of the trailer frame. A screw 66 is non-slidably and rotatably supported at its ends on the engine support frame 61 and threadedly engages a follower member (not shown) on the engine mounting pad 65 for adjustably moving the engine mounting pad relative to the engine support frame. The screw is operative in response to turning in one direction to release belt tension in the belts 54 and 56 to facilitate starting or to enable disconnection of one or the other of the belt drives from the engine, and the screw is operative in response to the turning in the other direction to tension both of the belts 54 and 56. A crank 67 is connected to the screw shaft to facilitate turning of the shaft and adjustment of the internal combustion engine, and a means is provided for selectively locking the crank in different angular positions to lock the engine mounting pad and engine in an adjusted position. In the preferred embodiment shown, the locking means includes a pin 68 that can be inserted through an opening in the crank and into any one of a plurality of angularly spaced openings 69*a* in a plate 69 secured to the engine support frame.

In accordance with another aspect of the present invention, the beam 10 is constructed and arranged to provide a hydraulic fluid reservoir internally of the beam to thereby avoid the weight and bulk of a separate hydraulic fluid reservoir. For this purpose the beam 10 is a box-type beam closed at its opposite ends by closure plates 10*a* welded to the beam to form a fluid reservoir inside the beam. A filler pipe 71 having a removable cap 72 (FIGS. 1 and 3) is provided to enable filling of the reservoir inside the beam 10. A flow reversing valve 73 is mounted on a pad 74 at one side of the beam at a location forwardly of the mandrel. The valve 73 is a four-way three-position valve of conventional construction and having an operating handle 75. As diagrammatically shown in FIG. 6, the control valve has an intake port 73*a* connected to the outlet 51*b* of the pump 51 and a return port 73*b* connected to the reservoir in the beam 10. The valve also has controlled outlet ports 73*c* and 73*d* that are connected to fittings 41*a* and 41*b* at opposite ends of the ram cylinder 41 to reversibly supply fluid pressure thereto. Pump 51 has its intake port 51*a* connected to the reservoir in the beam 10.

In accordance with another aspect with the present invention, a saw guard and saw guard operator is provided for guarding the saw blade to protect persons operating the log cut-off mechanism as well as those operating the log splitting mechanism. The saw guard is formed in two sections and includes an upper saw guard 81 arranged to extend around the upper portion of the saw 22 and a lower saw guard 82 arranged to extend around the lower portion of the saw blade. The upper saw guard has a semicircular configuration and includes a plate 83 that overlies the inner side of the saw blade 22, a peripheral wall 83*a* that extends around the periphery of the teeth and a flange wall 83*b* that extends inwardly of the peripheral wall 83*a* at the outer side of the blade to a point inwardly of the roots of the teeth on the saw to thereby protectively enclose the saw teeth. The upper saw guard 81 is supported for turning movement about the axis of the saw mandrel. As shown in FIG. 5, an outer sleeve member 85 is supported by a bracket 86 on the upper frame structure 21 and the outer sleeve has an inner diameter spaced outwardly from the saw mandrel 18. An inner sleeve 87 (FIG. 3) is secured to the back side of the plate 83 and it extends into the outer sleeve 85 to rotatably support the upper saw guard on the frame structure for turning about the axis of the mandrel. A collar 88 is secured to the end of the inner sleeve to hold the parts in axially assembled relation. A link 91 is pivotally connected at one end 91*a* to the forward portion of the log support 25, and is pivotally connected at its other end 91*b* to the upper saw guard to cause the upper saw guard to turn about the axis of the mandrel as the log support is moved from its rear position shown in FIG. 1 to its forward position adjacent the mandrel. The upper saw guard is arranged to extend around the upper portion of the saw blade with its lower rear edge 81*a* positioned adjacent the top of the wall 25*a* on the log support, when the log support is in its rear position as shown in FIG. 1. The end 91*b* of the link is connected to the upper saw guard at a location above the mandrel, when the saw guard is in its rear position shown in FIG. 1, at a location such that the lower rear edge of the upper saw guard remains forwardly of the log support as the log support is moved forwardly as shown in FIG. 2. The lower saw guard 82 is stationary and extends around the lower portion of the saw blade, and is constructed and arranged to receive the upper saw guard as the latter is turned about the axis of the mandrel. The lower saw guard 82 includes side flanges 82*a* and 82*b* that extend around the lower peripheral portion of the saw blade at the outer and inner sides of the blade, and forward and rear peripheral wall portions 82*c* and 82*d* that extend between the flanges 82*a* and 82*b*. The lower saw guard is open intermediate the portions 82*c* and 82*d* to allow discharge of sawdust. As is best shown in FIG. 3, the spacing between the flanges 82*a* and 82*b* of the lower saw guard is greater than the width of the upper saw guard to allow the upper saw guard to move into lower saw guard as shown in FIG. 2. The lower saw guard can be mounted on any stationary part of the trailer frame and, as shown, is mounted on a fender 90 attached to the trailer frame and which overlies the top of a ground engaging wheel 12. As best shown in FIGS. 1 and 2, a coil type tension spring 93 has one end 93*a* anchored to the trailer frame at a location spaced from the mandrel and its other end 93*b* attached to the upper saw guard at a location spaced from the mandrel and such that the spring 93 is progressively tensioned as the upper saw guard moves from its blade covering position shown in FIG. 1 toward its retracted position shown in FIG. 2. The spring 93 is arranged to yieldably urge the upper saw guard to its blade covering position shown in FIG. 1 and to also urge the log support 25 to its retracted position.

A retractable support leg 95 is swingably mounted at 96 on the forward end of the beam for movement between a support position shown in solid lines in FIGS. 1 and 2 and a retracted position shown in phantom lines in FIG. 2. A rear support leg 97 is a telescopically mounted in a sleeve 98 at the rear end of the beam and is adapted to be secured in a vertically adjusted position by a pin 99 (FIG. 5) to provide a stable support for the trailer frame when it is disconnected from the towing vehicle.

From the foregoing it is believed that the construction and operation of the log sawing and splitting machine will be readily understood. The log sawing mechanism is located at the rear of the trailer and the log splitting mechanism is located at the forward portion of the trailer frame so that both the log sawing and splitting mechanisms can be operated at the same time by different operators. The internal combustion engine is arranged to power both the log sawing and log splitting mechanism and it is mounted so that it can be readily adjusted to a position to relieve all driving loads on the internal combustion engine during start-up, and to also facilitate disconnection of the belt drive to either the saw or to the pump for driving the log splitting mechanism to enable selective operation of only one of the mechanisms if desired. The internal combustion engine can then be readily adjusted to a position to tension either or both of the belt drives and then locked in its adjusted position. The beam 10 not only provides a major component of the trailer frame but also supports the hydraulic splitting mechanism and, additionally, functions as the hydraulic reservoir for the hydraulic power system. The upper and lower saw guards are arranged to protect both the operators of the log sawing mechanism as well as the operators of the log splitting mechanism. The upper saw guard is mounted for turning about the axis of the saw mandrel into the lower saw guard in response to movement of the log support mechanism in a manner to maintain the upper saw guard out of the path of the log being sawed.

The embodiments of the invention in which an exclusive property of privilege is claimed are defined as follows:

1. A mobile log sawing and splitting machine comprising a trailer frame including an elongated lengthwise extending beam having a vehicle engaging hitch at its forward end and a pair of ground engaging wheels mounted at relatively opposite sides of the beam adjacent the rear end of the trailer frame, a saw mandrel mounted on the trailer frame adjacent its rear end for rotation about a horizontal axis transverse to and spaced above the beam, a circular saw blade mounted on the mandrel and spaced from one side of the beam, an elongated horizontal log support extending crosswise of the trailer frame at the rear end thereof and mounted for movement between a rear position adjacent the rear side of the saw blade and a forward position adjacent the mandrel, a log splitting wedge mounted on the beam adjacent its forward end and a log pusher mounted for sliding movement lengthwise of the beam, a hydraulic ram including a cylinder extending lengthwise of the beam below the mandrel and a piston rod extending from the cylinder and connected to the log pusher for moving it toward and away from the wedge, hydraulic power means including a hydraulic pump and a hydraulic fluid reservoir and a control valve for reversibly supplying hydraulic fluid to the ram, the hydraulic pump being mounted on the trailer frame adjacent its rear end, an internal combustion engine, engine mounting means mounting the engine on the trailer frame at a location forwardly of the mandrel and hydraulic pump, the engine mounting means including an engine support frame and an engine mounting pad mounted on the support frame for sliding movement along an adjustment path having at least a substantial component lengthwise of the trailer frame, a first belt drive means connecting the engine to the saw mandrel and a second belt drive means connecting the engine to the hydraulic pump, screw means engaging the engine support frame and engine mounting pad for adjustably moving the engine mounting pad relative to the engine support frame, the screw means being operative in response to turning in one direction to release belt tension in the first and second belt drive means to facilitate starting the engine and being operative in response to turning in the other direction to tension the belts in the first and second belt drives, and means for selectively locking the screw in different anglular positions to lock the engine mounting pad and engine in an adjusted position.

2. A mobile log sawing and splitting machine according to claim 1 wherein at least a portion of the beam is a box-shaped beam, said hydraulic fluid reservoir being inside said box-shaped beam.

3. A mobile log sawing and splitting machine according to claim 1 including an upper saw guard mounted for turning about the axis of the saw mandrel and having a semi-circular configuration to extend around the upper portion of the saw blade, and link means pivotally connected at one end to the log support and at its other end to the upper saw guard at a location eccentric to the axis of the mandrel for moving the upper saw guard angularly about the mandrel axis as the log support is moved between its rear and forward positions.

4. A mobile log sawing and splitting machine according to claim 3 including a stationary lower saw guard mounted on the trailer frame and extending around a lower portion of the saw blade, said lower saw guard being dimensioned to receive the upper saw guard when the upper saw guard is moved angularly about the mandrel axis.

5. A mobile log sawing and splitting machine according to claim 4 wherein said log support has an upwardly extending wall along its forward edge, said upper saw guard being positioned with its lower rear edge portion dispoed adjacent the upwardly extending wall on the log support when the latter is in its rear position.

6. A mobile log sawing and splitting machine according to claim 5 including a tension spring attached at one end to the trailer frame at a location eccentric to the mandrel axis and at the other end to upper saw guard at a location such that the spring tension is progressively increased as the log support is moved from its rear toward its forward position.

7. A mobile log sawing and splitting machine according to claim 4 wherein at least a portion of the beam is a box-shaped beam, said hydraulic fluid reservoir being inside said box-shaped beam.

8. A mobile log sawing and splitting machine according to claim 3 including a latch means for releasably latching the log support in its rear position, and manually operable latch release means mounted on the log support at a location spaced from the saw blade.

9. A mobile log sawing and splitting machine comprising a trailer frame including an elongated lengthwise extending beam having a vehicle engaging hitch at its forward end and a pair of ground engaging wheels mounted at relatively opposite sides of the beam adjacent the rear end of the trailer frame, a saw mandrel mounted on the trailer frame adjacent its rear end for rotation about a horizontal axis transverse to and spaced above the beam, a circular saw blade mounted on the mandrel and spaced from one side of the beam, an elongated horizontal log support extending crosswise of the trailer frame at the rear end thereof and mounted for movement between a rear position adjacent the rear side of the saw blade and a forward position adjacent the mandrel, a log splitting wedge mounted on the beam adjacent its forward end and a log pusher mounted for sliding movement lengthwise of the beam, a hydraulic ram including a cylinder extending lengthwise of the beam below the mandrel and a piston rod extending from the cylinder and connected to the log pusher for moving it toward and away from the wedge, hydraulic power means including a hydraulic pump and a hydraulic fluid reservoir and a control valve for reversibly supplying hydraulic fluid to the ram, the hydraulic pump being mounted on the trailer frame adjacent its rear end, an internal combustion engine, engine mounting means mounting the engine on the trailer frame at a location forwardly of the mandrel and hydraulic pump, a first belt drive means connecting the engine to the saw mandrel and a second belt drive means connecting the engine to the hydraulic pump, an upper saw guard mounted for turning about the axis of the saw mandrel and having a semi-circular configuration to extend around the upper portion of the saw blade, link means pivotally connected at one end to the log support and at its other end to the upper saw guard at a location eccentric to the axis of the mandrel for moving the upper saw guard angularly about the mandrel axis as the log support is moved between its rear and forward positions, a stationary lower saw guard mounted on the trailer frame and extending around a lower portion of the saw blade, said lower saw guard being dimensioned to receive the upper saw guard when the upper saw guard is moved angularly about the mandrel axis 10. A mobile log sawing and splitting machine according to claim 9 wherein said log support has an upwardly extending wall along its forward edge, said upper saw guard being positioned with its lower rear edge portion disposed adjacent the upwardly extending wall on the log support when the latter is in its rear position.

11. A mobile log sawing and splitting machine according to claim 10 including a tension spring attached at one end to the trailer frame at a location eccentric to the mandrel axis and at the other end to upper saw guard at a location such that the spring tension is progressively increased as the log support is moved from its rear toward its forward position.

12. A mobile log sawing and splitting machine according to claim 9 wherein at least a portion of the beam is a box-shaped beam, said hydraulic fluid reservoir being inside said box-shaped beam.

* * * * *